US006685599B2

(12) United States Patent
Wang et al.

(10) Patent No.: US 6,685,599 B2
(45) Date of Patent: Feb. 3, 2004

(54) FRONT COVER PLATE FOR AN ELECTRIC TREADMILL

(76) Inventors: Leao Wang, No. 1, Lane 233, Sec. 2, Charng Long Rd., Taiping 411 (TW); Peter Wu, No. 1, Lane 233, Sec. 2, Charng Long Rd., Taiping 411 (TW)

( * ) Notice: Subject to any disclaimer, the term of this patent is extended or adjusted under 35 U.S.C. 154(b) by 41 days.

(21) Appl. No.: 10/045,732

(22) Filed: Jan. 15, 2002

(65) Prior Publication Data

US 2003/0134717 A1 Jul. 17, 2003

(51) Int. Cl.[7] ..... A63B 22/02
(52) U.S. Cl. ..... 482/54
(58) Field of Search ..... 482/54, 51

(56) References Cited

U.S. PATENT DOCUMENTS 5,476,430 A * 12/1995 Lee et al. ..... 482/54
5,711,745 A * 1/1998 Yang ..... 482/54

* cited by examiner

*Primary Examiner*—Stephen R. Crow
(74) *Attorney, Agent, or Firm*—Troxell Law Office PLLC; Kuo-Hsiung Chiu

(57) ABSTRACT

The present invention relates to a front cover plate for an electric treadmill which includes an upright frame, a base frame, a front supporting let and a rear supporting leg. A console is mounted on the upright frame, and a handrail is fitted to either side of the upright frame. A continuous belt extends longitudinally around a base frame. In addition, a bottom cover plate is pivotably connected to connecting rods at both sides of the front end of the treadmill by means of a first screw set. Besides, a front cover plate is pivotably connected to the front end of the base frame by a second screw set. The front cover plate is covered by the bottom cover plate. Accordingly, the transmission system of the motor at the bottom of the base frame can be hidden by both cover plates. Meanwhile, foreign objects can be prevented from entering into the front end of the treadmill. Therefore, the transmission system of the motor can be protected from damage.

2 Claims, 4 Drawing Sheets

FRONT COVER PLATE FOR AN ELECTRIC TREADMILL

BACKGROUND OF THE INVENTION

1. Field of the Invention

The present invention relates to a front cover plate for an electric treadmill, and more particularly, to a device which prevents foreign objects from entering into the front end of the treadmill. Therefore, the transmission system of motor can be protected from damage. Moreover, the whole appearance can be beautified.

2. Description of the Prior Art

As well known, each electric treadmill is fitted with a transmission system of motor at the bottom end thereof for an in-place rotation of the continuous belt. The supporting angle of the base frame of the treadmill is mostly (manually or electrically) adjustable to change the walking slope. When the elevation angle (slope) of the base frame is increased, the transmission system will be unprotectedly exposed while the whole appearance is adversely affected. In addition, the transmission system of motor can be damaged when the foreign objects intrude thereinto.

SUMMARY OF THE INVENTION

It is a primary object of the present invention to remove the above-mentioned drawbacks and to provide a front cover plate for an electric treadmill through which the transmission system of motor can be protected to ensure the long-term operation function.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
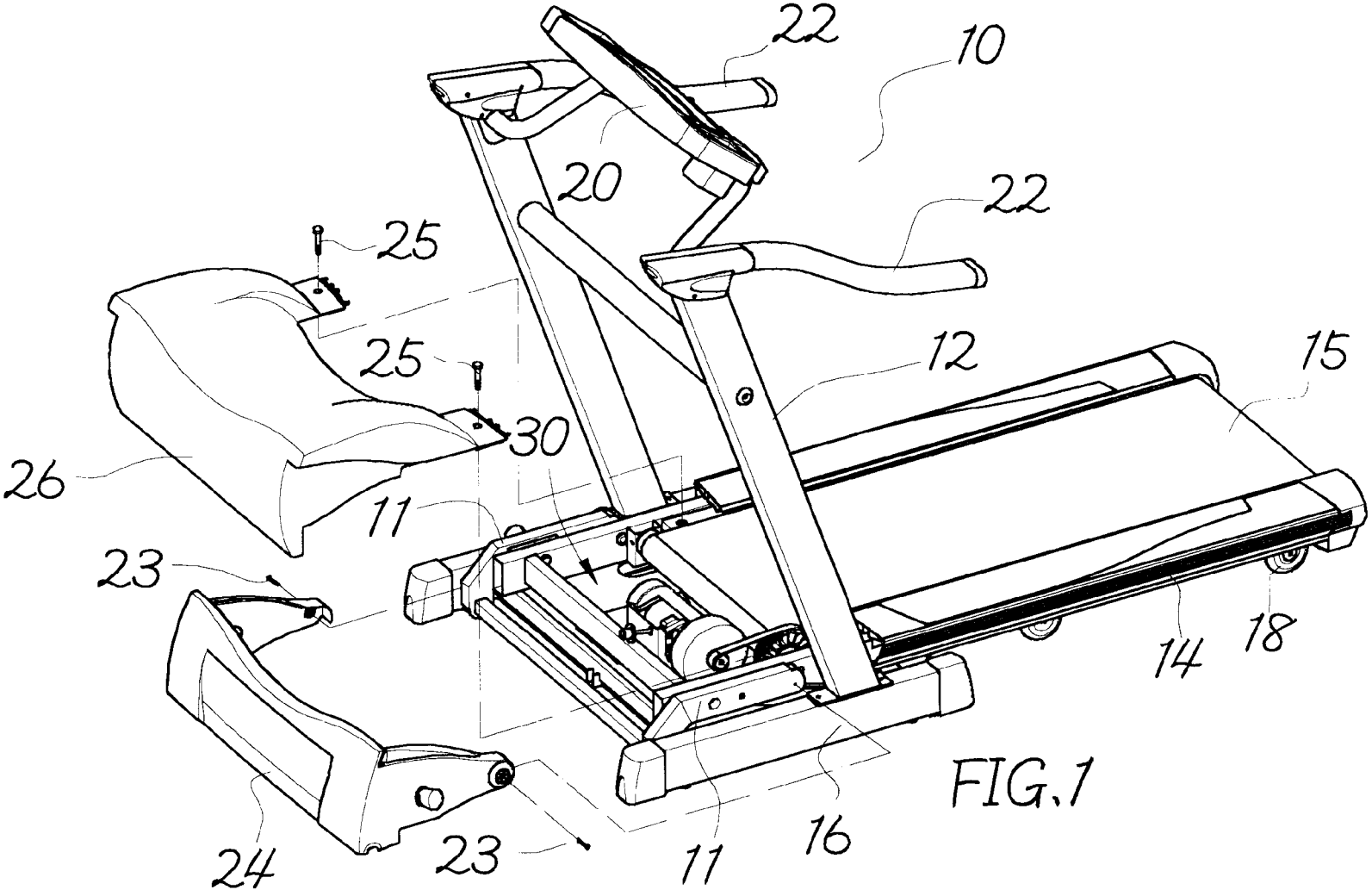
FIG. 1 is a perspective exploded view of a preferred embodiment of the present invention.
Figure 2:
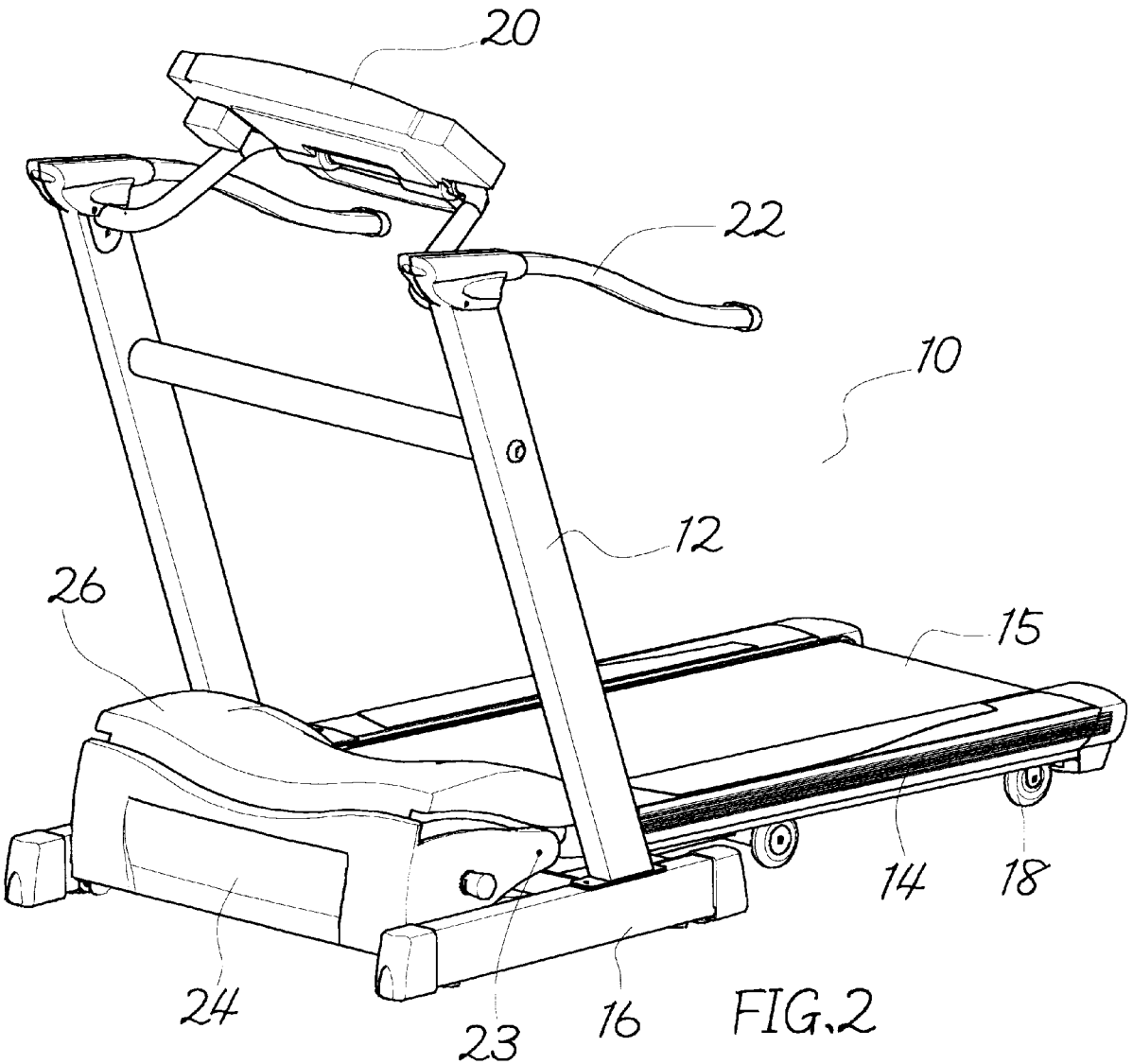
FIG. 2 is a perspective view of FIG. 1.

First of all, referring to FIGS. 1 and 2, the electric treadmill 10 of the preferred embodiment of the present invention includes an upright frame 12, a base frame 14, a front supporting leg 16 and a rear supporting leg 18. A console 20 is mounted on the upright frame 12, and a handrail 22 is fitted to either side thereof. A continuous belt 15 extends longitudinally around the base frame 14 for an in-place rotation. In addition, a bottom cover plate 24 is pivotably connected to connecting rods 11 at both sides of the front end of the treadmill 10 by means of a first screw set 23. Besides, a front cover plate 26 is pivotably connected to the front end of the base frame 14 by means of a second screw set 25. The front cover plate 26 is covered by the bottom cover plate 24. Accordingly, the transmission system of motor 30 at the bottom of the base frame 14 can be hidden by both cover plates 24, 26.

Figure 3:
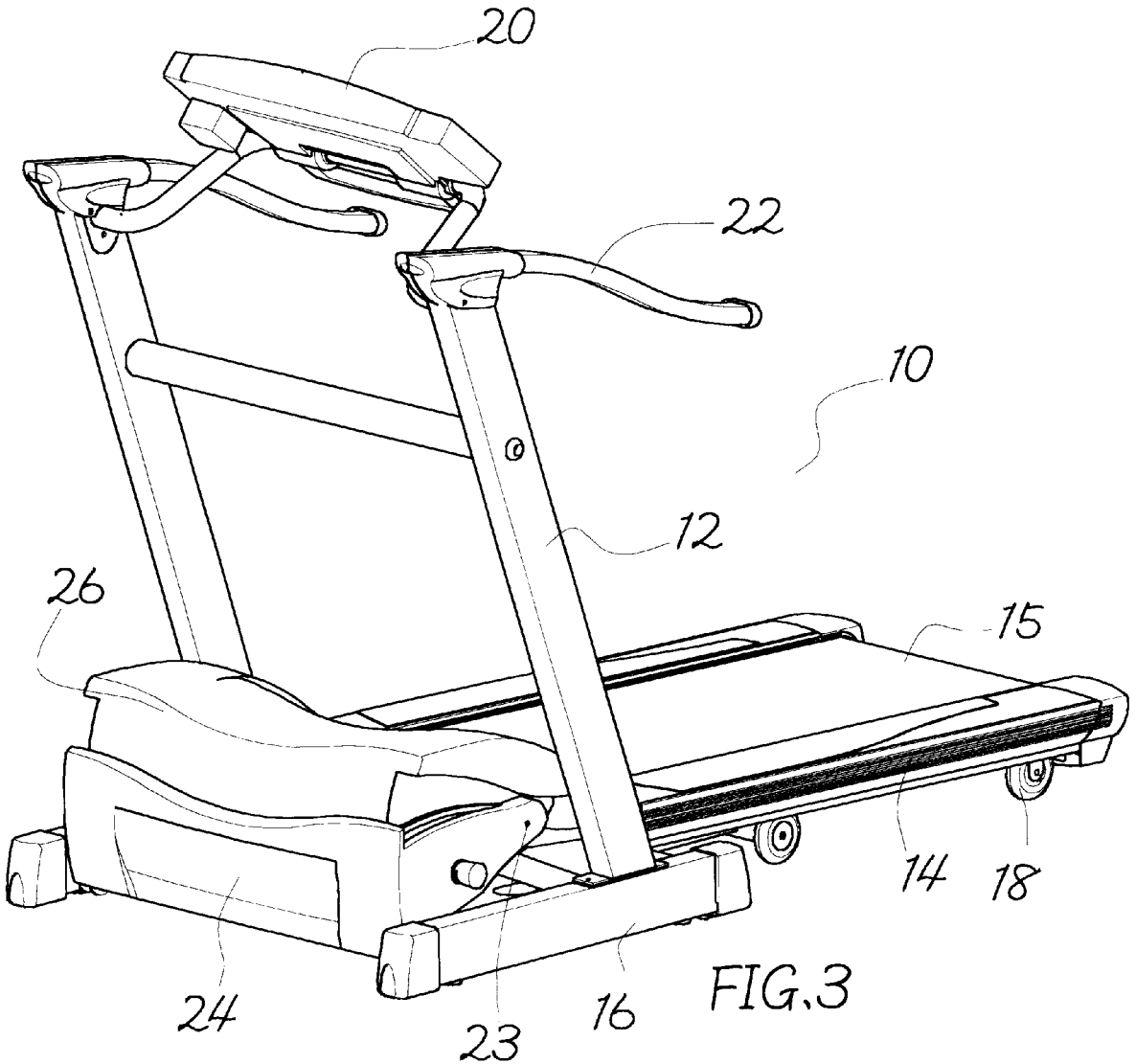
FIG. 3 is a perspective view of FIG. 1, showing the elevation angle of the base frame is raised.

As illustrated in FIG. 3, when the elevation angle (walking slope) of the base frame 14 is increased to the maximum, the transmission system of motor 30 can also be hidden by both cover plates 24, 26 and not unprotectedly exposed.

Figure 4:
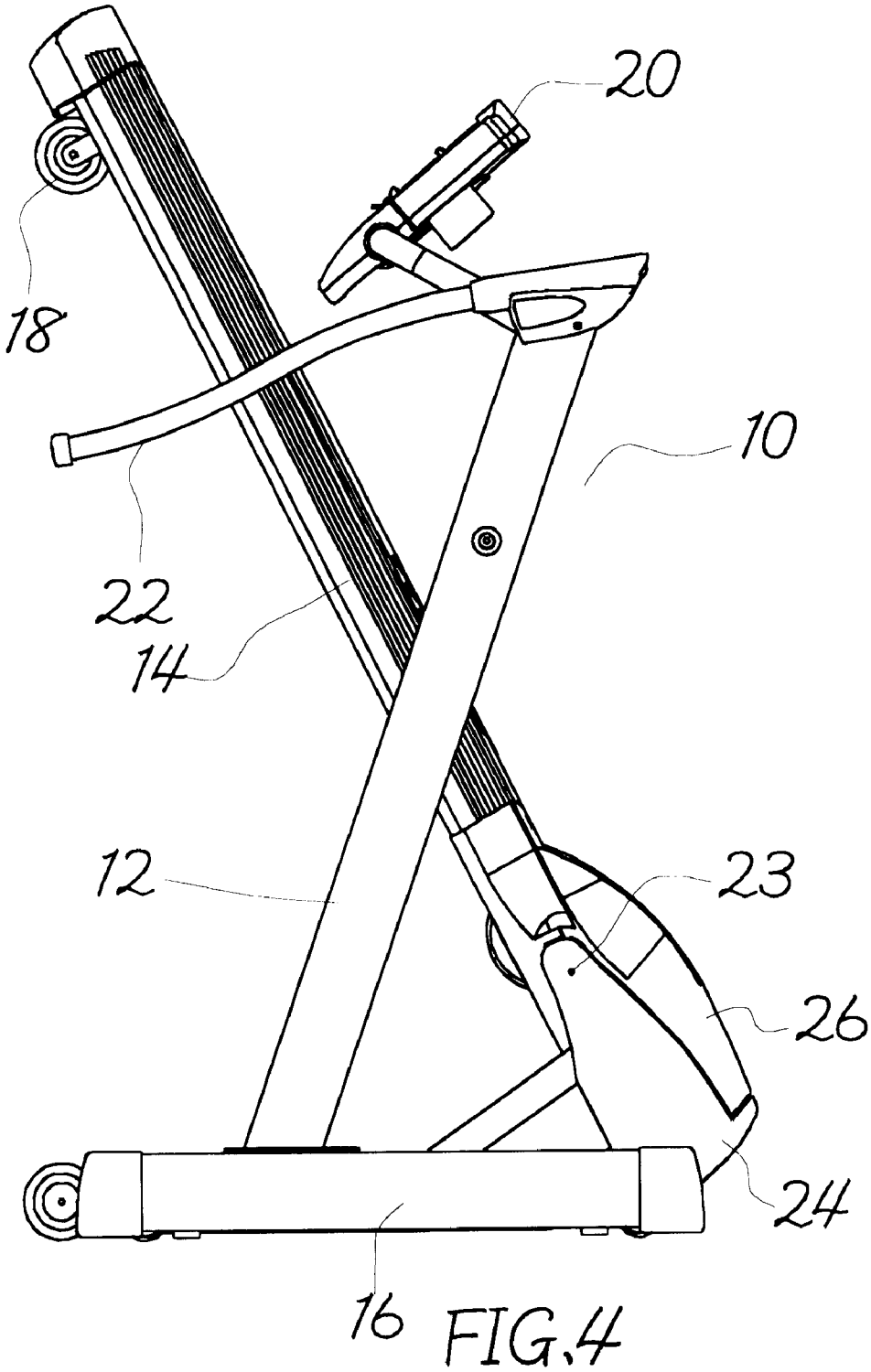
FIG. 4 is a side view of the present invention in storage position.

As illustrated in FIG. 4, when the base frame 14 is folded-up to the storage position, both cover plates 24, 26 is also brought upward with the base frame 14.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A front cover plate for an electric treadmill comprising:

a) a front cover plate connected to a front of the treadmill; and b) a bottom cover plate pivot connected to the treadmill and overlapping the front cover plate, wherein the bottom cover plate pivots downwardly with respect to the front cover plate when the front of the treadmill is elevated such that a transmission of the treadmill is protected.

2. The front cover plate for an electric treadmill according to claim 1, wherein the bottom cover plate is pivotally connected to a pair of connecting rods connected to opposing sides of the treadmill.

* * * * *